US011242819B2

(12) United States Patent
Kageyama et al.

(10) Patent No.: US 11,242,819 B2
(45) Date of Patent: Feb. 8, 2022

(54) CYLINDER HEAD AND ENGINE

(71) Applicant: Komatsu Ltd., Tokyo (JP)

(72) Inventors: Yuuki Kageyama, Tokyo (JP); Akihiro Miki, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 17/041,199

(22) PCT Filed: Feb. 17, 2020

(86) PCT No.: PCT/JP2020/006002
§ 371 (c)(1),
(2) Date: Sep. 24, 2020

(87) PCT Pub. No.: WO2020/162640
PCT Pub. Date: Aug. 13, 2020

(65) Prior Publication Data
US 2021/0254579 A1 Aug. 19, 2021

(51) Int. Cl.
*F02F 1/36* (2006.01)
*F02M 26/65* (2016.01)

(52) U.S. Cl.
CPC ..... *F02F 1/36* (2013.01); *F02M 26/65* (2016.02)

(58) Field of Classification Search
CPC ..... F02M 26/65; F02F 1/36
See application file for complete search history.

(56) References Cited

U.S. PATENT DOCUMENTS

| | | | | |
|---|---|---|---|---|
| 4,491,099 | A * | 1/1985 | Bonvallet | F01L 1/12 123/90.27 |
| 10,125,718 | B1 | 11/2018 | Peschini et al. | |
| 2002/0043254 | A1 * | 4/2002 | Iizuka | F02M 26/30 123/568.13 |
| 2004/0255918 | A1 | 12/2004 | Mackey et al. | |
| 2015/0136066 | A1 * | 5/2015 | Hikita | F01M 9/10 123/196 R |
| 2016/0186704 | A1 | 6/2016 | Murotani et al. | |
| 2019/0072056 | A1 | 3/2019 | Yoon et al. | |
| 2019/0078540 | A1 | 3/2019 | Uchibori et al. | |
| 2020/0003084 | A1 * | 1/2020 | Richards | F01L 1/047 |
| 2020/0132015 | A1 | 4/2020 | Kageyama | |
| 2021/0348579 | A1 | 11/2021 | Kageyama et al. | |

FOREIGN PATENT DOCUMENTS

| | | | |
|---|---|---|---|
| CN | 204610061 | U | 9/2015 |
| CN | 205744195 | U | 11/2016 |
| CN | 206386201 | U | 8/2017 |
| CN | 109952423 | A | 6/2019 |

(Continued)

*Primary Examiner* — Kevin A Lathers
(74) *Attorney, Agent, or Firm* — Locke Lord LLP

(57) ABSTRACT

A cylinder head includes: a cylinder head body that includes a lower deck, an upper deck defining a first cooling water space together with the lower deck, and valve hole-forming walls; a rocker housing that includes a rocker-side wall formed integrally with the cylinder head body; an expansion wall portion that expands from the cylinder head body and defines a second cooling water space communicating with the first cooling water space and extending up to a position over the upper deck; and an EGR passage-forming portion that is provided in the second cooling water space.

14 Claims, 7 Drawing Sheets

(56) References Cited

FOREIGN PATENT DOCUMENTS

| | | | | | |
|---|---|---|---|---|---|
| CN | 109996947 | A | | 7/2019 | |
| CN | 209724510 | U | | 12/2019 | |
| EP | 1233170 | A2 | | 8/2002 | |
| EP | 2063097 | A1 | | 5/2009 | |
| EP | 2573378 | A1 | | 3/2013 | |
| EP | 3438438 | A1 | | 2/2019 | |
| EP | 3505747 | A1 | | 7/2019 | |
| JP | 2002004955 | A | * | 1/2002 | ..... F02M 26/31 |
| JP | 2004-300940 | A | | 10/2004 | |
| JP | 2013-083206 | A | | 5/2013 | |
| JP | 5423169 | B2 | | 2/2014 | |
| JP | 5477466 | B2 | | 4/2014 | |
| JP | 5637964 | B2 | | 12/2014 | |
| JP | 2015-034530 | A | | 2/2015 | |
| JP | 2015-124763 | A | | 7/2015 | |
| JP | 2017-190708 | A | | 10/2017 | |

* cited by examiner

CYLINDER HEAD AND ENGINE

TECHNICAL FIELD

The present invention relates to a cylinder head and an engine.

BACKGROUND ART

A technique called exhaust gas recirculation (EGR) is widely used for the purpose of the reduction of thermal NOx contained in exhaust gas generated during combustion in an engine and the improvement of fuel efficiency during a partial load. Particularly, in an EGR device of a type called external EGR, part of exhaust gas sent to an exhaust manifold from the cylinders of an engine is guided to an intake manifold through an EGR passage and flows to return to cylinder bores.

An engine disclosed in Patent Literature 1 is known as example of an engine including such an EGR device. In the engine disclosed in Patent Literature 1, an EGR passage through which exhaust gas (EGR gas) passes is provided in a cylinder head of the engine. In addition, a water jacket is provided on one side of the EGR passage. Exhaust gas (EGR gas) present in the EGR passage is cooled by heat exchange with cooling water that flows through the water jacket. The cooled exhaust gas is guided to the intake manifold.

CITATION LIST

Patent Literature

[Patent Literature 1]
Japanese Unexamined Patent Application, First Publication No. 2015-34530

SUMMARY OF INVENTION

Technical Problem

There is a demand for an increase in the cross-sectional area of a flow passage of the EGR passage or the volume of the EGR passage in order to increase the cooling efficiency of EGR gas. However, the cylinder head in the related art is generally formed separately from the cylinder block. Accordingly, mounting holes into which bolts for fixing the cylinder head to the cylinder block are to be inserted are formed in the cylinder head. For this reason, there is a concern that dimensions may be restricted in a case where the EGR passage is provided in the cylinder head. As a result, the cooling efficiency of EGR gas is not sufficiently improved.

The present invention has been made in consideration of the above-mentioned problem, and an object of the present invention is to provide a cylinder head and an engine that can more efficiently cool EGR gas.

Solution to Problem

A cylinder head according to a first aspect of the present invention includes: a cylinder head body that includes a lower deck, an upper deck provided above the lower deck so as to face the lower deck and defining a first cooling water space together with the lower deck, and a plurality of valve hole-forming walls extending over the lower deck and the upper deck and formed in a cylinder-row direction; a rocker housing including a rocker-side wall that is formed integrally with the cylinder head body so as to stand up from an end portion of the upper deck provided on one side in the cylinder-row direction; an expansion wall portion that is provided over the lower deck and the rocker-side wall so as to expand from the cylinder head body to one side in the cylinder-row direction, and defines a second cooling water space communicating with one side of the first cooling water space in the cylinder-row direction and extending up to a position over the upper deck; and an EGR passage-forming portion that is provided in the second cooling water space and extends in a front-rear direction crossing the cylinder-row direction.

An engine according to a first aspect of the present invention includes the cylinder head according to the above-mentioned aspect, and a cylinder block that includes a cylinder bore forming a cylinder and is covered with the cylinder head from above.

Advantageous Effects of Invention

According to the present invention, it is possible to provide a cylinder head and an engine that can more efficiently cool EGR gas.

DESCRIPTION OF EMBODIMENTS

Figure 1:
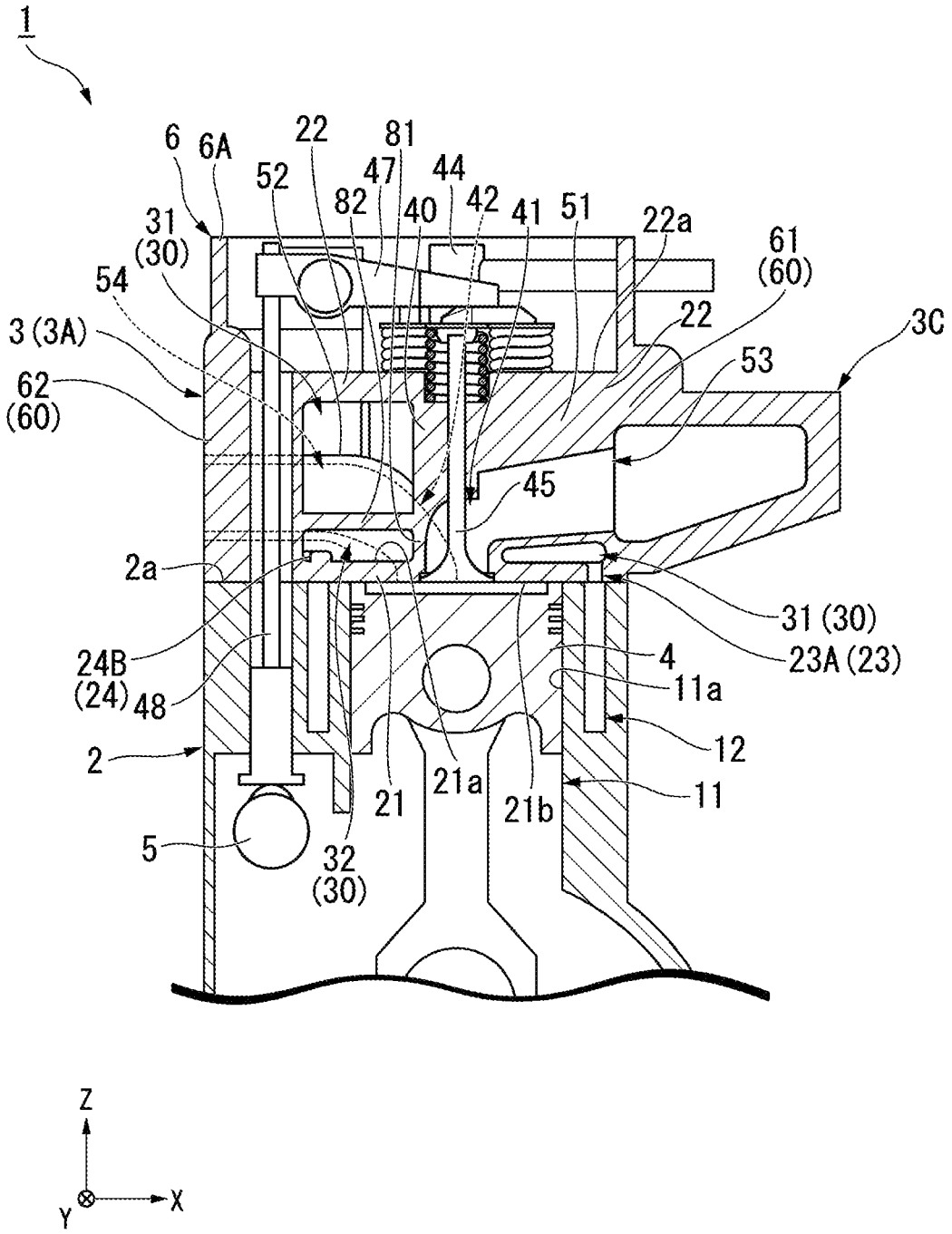
FIG. 1 is a cross-sectional view of an engine that includes a cylinder head according to an embodiment of the present invention.

Hereinafter, an embodiment of the present invention will be described with reference to FIGS. 1 to 7. As shown in FIG. 1, a cylinder head body 3A according to the present embodiment forms an engine 1 together with a cylinder block 2. The engine 1 of the present embodiment is a diesel engine.

In FIGS. 1 to 7, a direction in which the cylinder block 2 and the cylinder head body 3A are arranged is referred to as a Z-axis direction (vertical direction). Further, a direction orthogonal to the Z-axis direction is referred to as a Y-axis direction (cylinder-row direction). Furthermore, a direction orthogonal to the Z-axis direction and the Y-axis direction is referred to as an X-axis direction (front-rear direction).

<Cylinder Block>

Figure 2:
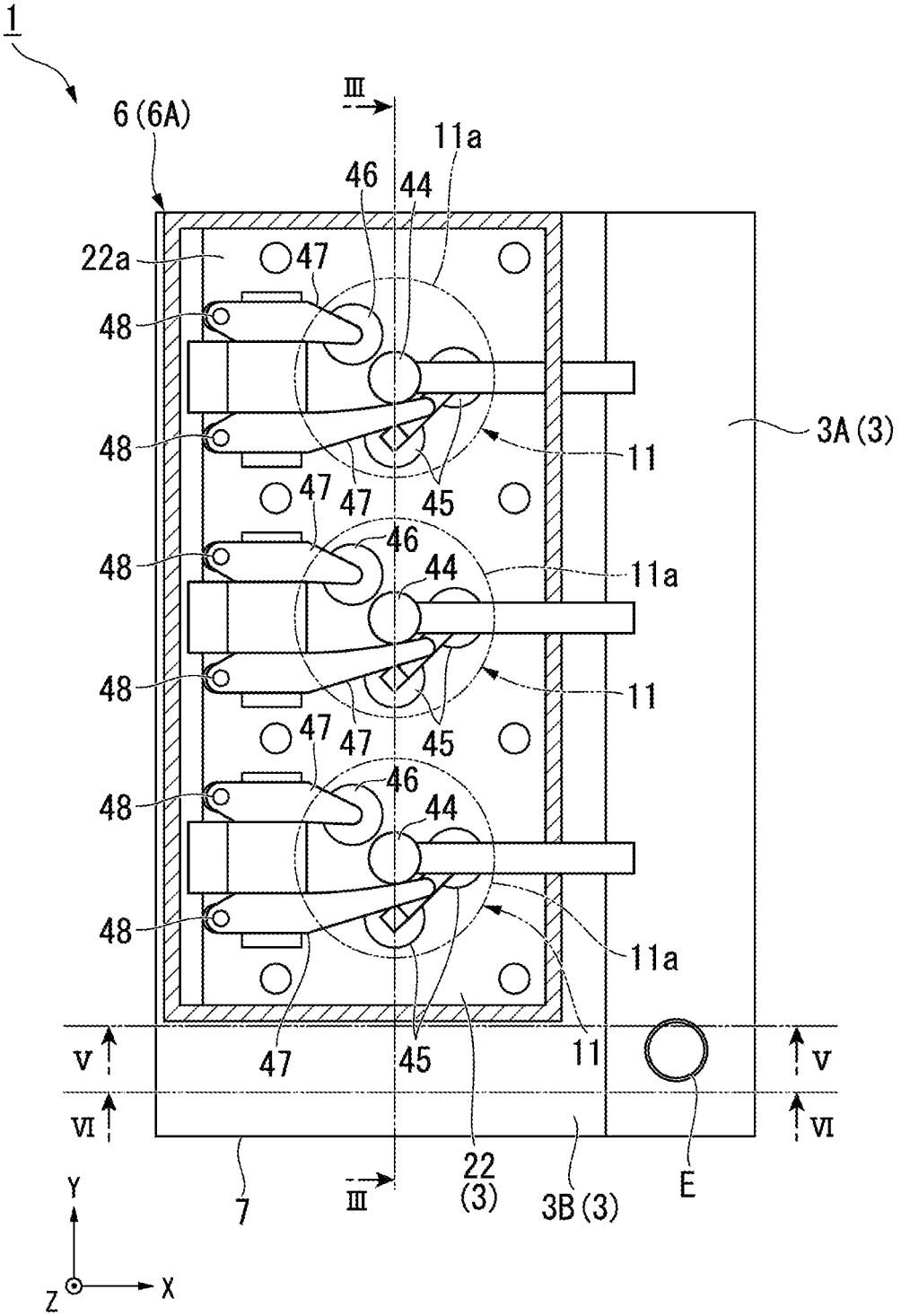
FIG. 2 is a top view of the engine of FIG. 1 that is viewed from the upper side.

As shown in FIG. 1, the cylinder block 2 includes cylinder bores 11*a* forming cylinders 11. Each cylinder 11 is a space in which a piston 4 is disposed. The cylinders 11 are open on an upper surface 2*a* of the cylinder block 2. The piston 4 receives the pressure of combustion gas combusted in the cylinder 11 and reciprocates in the Z-axis direction. The cylinder block 2 of the present embodiment includes a plurality of (three in the example shown in the drawing) cylinders 11 as shown in FIG. 2. The plurality of cylinders 11 are arranged in a line in the Y-axis direction. In the following description, a first orthogonal direction in which the plurality of cylinders 11 are arranged is referred to as the cylinder-row direction.

As shown in FIG. 1, a block-side flow space 12 which surrounds the respective cylinder bores 11*a* and in which cooling water flows is formed in the cylinder block 2. Cooling water for cooling the cylinder bores 11*a* flows in the block-side flow space 12. The block-side flow space 12 is open on the upper surface 2*a* of the cylinder block 2.

As shown in FIG. 1, a camshaft 5 for driving rocker arms 47 to be described later is disposed in the cylinder block 2. The camshaft 5 extends in the cylinder-row direction.

The camshaft 5 is rotated according to the reciprocation of the pistons 4.

<Cylinder Head>

As shown in FIG. 1, the cylinder head 3 is disposed so as to overlap the upper surface 2*a* of the cylinder block 2 and so as to cover the upper openings of the cylinders 11. The cylinder head 3 includes the cylinder head body 3A and an expansion portion 3B (FIG. 2).

<Cylinder Head Body>

As shown in FIG. 1, the cylinder head body 3A includes a lower deck 21 and an upper deck 22. Each of the lower deck 21 and the upper deck 22 is formed in the shape of a plate. The lower deck 21 is a portion of the cylinder head body 3A that is disposed so as to overlap the upper surface 2*a* of the cylinder block 2. The upper deck 22 is provided above the lower deck 21 so as to face the lower deck 21. That is, the lower deck 21 and the upper deck 22 arc arranged at intervals in the Z-axis direction. A head-side flow space 30 in which cooling water flows is defined between the upper deck 22 and the lower deck 21.

A cooling water introduction hole 23 is formed in the lower deck 21. The cooling water introduction hole 23 penetrates the lower deck 21 in the thickness direction of the lower deck 21 (the Z-axis direction). The cooling water introduction hole 23 connects the block-side flow space 12 of the cylinder block 2 to the head-side flow space 30 of the cylinder head body 3A.

<Valve Hole-Forming Wall>

As shown in FIG. 1, the cylinder head body 3A includes valve hole-forming walls 40 that extend up to the upper deck 22 from the lower deck 21. Intake valve holes 41 and exhaust valve holes 42 (dotted line), which are open on a lower surface 21*b* of the lower deck 21, are formed in the valve hole-forming walls 40. The lower surface 21*b* of the lower deck 21 is a surface that faces the upper surface 2*a* of the cylinder block 2. The intake valve holes 41 and the exhaust valve holes 42 are formed at the lower end portions of the valve hole-forming walls 40 positioned close to the lower deck 21. The intake valve holes 41 and the exhaust valve holes 42 communicate with the cylinders 11 of the cylinder block 2, respectively.

As shown in FIG. 1, fuel injectors 44 (injector) are inserted into the valve hole-forming walls 40 in the vertical direction. The fuel injectors 44 penetrate the cylinder head body 3A in the vertical direction. That is, the fuel injectors 44 protrude from the lower surface 21*b* of the lower deck 21 and an upper surface 22*a* of the upper deck 22.

As shown in FIGS. 1 and 2, intake valves 45 for opening and closing the respective intake valve holes 41 are provided in the valve hole-forming walls 40 so as to be movable in the vertical direction. Part of each intake valve 45 protrudes from the upper surface 22*a* of the upper deck 22. Further, exhaust valves 46 for opening and closing the respective exhaust valve holes 42 (FIG. 1) are provided in the valve hole-forming walls 40 as with the intake valves 45. The configuration and arrangement of the exhaust valves 46 are the same as those of the intake valves 45.

The respective rocker arms 47 provided on the upper surface 22*a* of the upper deck 22 are caused to rock, so that the intake valves 45 and the exhaust valves 46 are driven. Push rods 48 penetrating the cylinder head body 3A in the vertical direction are moved in the vertical direction with the rotation of the above-mentioned camshaft 5, so that the rocker arms 47 rock.

Figure 3:
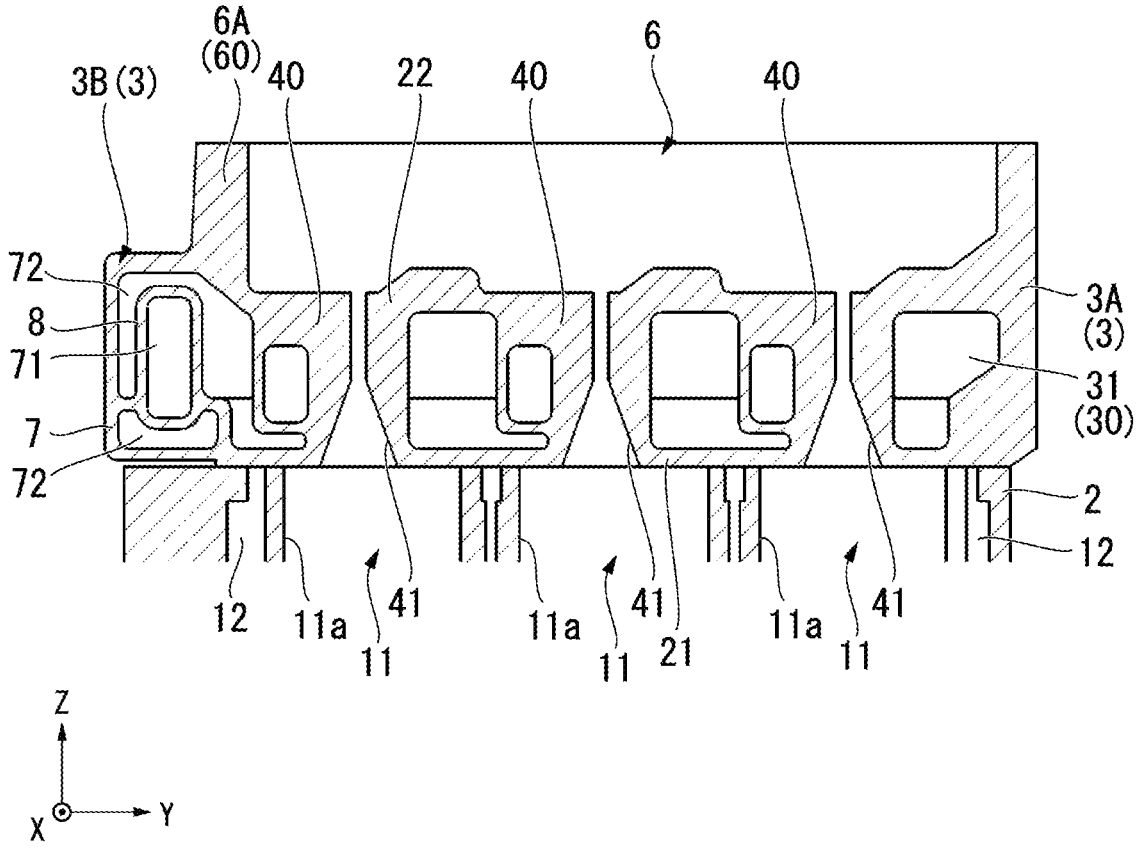
FIG. 3 is a cross-sectional view taken along line of FIG. 2.

In the present embodiment, as shown in FIG. 3, a plurality of (three in the example shown in the drawing) valve hole-forming walls 40 are arranged in a line at intervals in the Y-axis direction. The plurality of valve hole-forming walls 40 are positioned so as to correspond to the plurality of cylinders 11, respectively. In the present embodiment, two intake valve holes 41 and one exhaust valve hole 42 (shown in FIG. 1) correspond to one cylinder 11.

<Intake Port-Forming Wall>

As shown in FIG. 1, the cylinder head body 3A includes intake port-forming walls 51 connected to the valve hole-forming walls 40. The intake port-forming wall 51 is positioned on one side of the valve hole-forming wall 40 in the Z-axis direction and the X-axis direction (the positive side in the X-axis direction, the right side in FIG. 1). The intake port-forming walls 51 are formed integrally with the lower surface of the upper deck 22 and are disposed above the lower deck 21. Spaces between the lower deck 21 and the intake port-forming walls 51 form the head-side flow space 30.

Intake ports 53, which communicate with the intake valve holes 41, are formed in the intake port-forming walls 51. The intake ports 53 extend from the intake valve holes 41 to one side in the X-axis direction. That is, the intake ports 53 are formed so as to take in gas from the intake side of the cylinder head body 3A that is one side in the X-axis direction.

The plurality of (three in the example shown in the drawing) intake port-forming walls 51 are arranged at intervals in the Y-axis direction so as to correspond to the plurality of valve hole-forming walls 40, respectively. Two intake ports 53, which communicate with two intake valve holes 41 formed in each valve hole-forming wall 40, are formed in each intake port-forming wall 51.

<Exhaust Port-Forming Portion>

As shown in FIG. 1, the cylinder head body 3A includes exhaust port-forming portions 52 that are connected to the respective valve hole-forming walls 40. The exhaust port-forming portion 52 is positioned on the other side of the valve hole-forming wall 40 in the X-axis direction (the negative side in the X-axis direction, the left side in FIG. 1). The exhaust port-forming portions 52 are disposed with intervals between themselves and the lower deck 21 and the upper deck 22 above the lower deck 21 and below the upper deck 22. Spaces between the lower deck 21 and the exhaust port-forming portions 52 and spaces between the upper deck 22 and the exhaust port-forming portions 52 form the head-side flow space 30.

Exhaust ports 54, which communicate with the exhaust valve holes 42, are formed in the exhaust port-forming portions 52. The exhaust ports 54 extend from the exhaust valve holes 42 to the other side in the X-axis direction. That is, the exhaust ports 54 are formed so as to discharge gas to the exhaust side of the cylinder head body 3A that is the other side in the X-axis direction.

The plurality of (three) exhaust port-forming portions 52 are arranged at intervals in the first orthogonal direction so as to respectively correspond to the plurality of valve hole-forming walls 40.

<Outer Peripheral Wall>

As shown in FIG. 1, the cylinder head body 3A further includes an outer peripheral wall 60 that is provided on the outer peripheral side of the above-mentioned plurality of valve hole-forming walls 40. The outer peripheral wall 60 extends up to the upper deck 22 from the lower deck 21 so as to surround the plurality of valve hole-forming walls 40 and defines the head-side flow space 30 together with the lower deck 21 and the upper deck 22.

The outer peripheral wall 60 includes two side walls 61 and 62 and one end wall (not shown) that is provided on the Y-axis side in FIG. 2. As shown in FIG. 1, the two side walls 61 and 62 extend in the Y-axis direction from both ends of the cylinder head body 3A in the X-axis direction. The above-mentioned intake port-forming walls 51 are formed integrally with the intake-side side wall 61, which is positioned on the intake side, of the two side walls 61 and 62. The intake ports 53 penetrate the intake-side side wall 61. The above-mentioned exhaust port-forming portions 52 arc formed integrally with the exhaust-side side wall 62, which is positioned on the exhaust side, of the two side walls 61 and 62. The exhaust ports 54 penetrate the exhaust-side side wall 62. Further, the above-mentioned push rods 48 penetrate the exhaust-side side wall 62 in the Z-axis direction. The plurality of push rods 48 are arranged at intervals in the Y-axis direction.

<Head-Side Flow Space>

As shown in FIG. 1, in the cylinder head body 3A of the present embodiment, the head-side flow space 30 is partitioned into two spaces by a first partition wall 81 and a second partition wall 82.

The first partition wall 81 partitions a lower portion of the head-side flow space 30, which is positioned close to the lower deck 21 in the Z-axis direction, into an intake-side space and an exhaust-side space. The first partition wall 81 is formed to connect the adjacent valve hole-forming walls 40 and to connect the valve hole-forming walls 40, which are positioned at both ends in a direction where the plurality of valve hole-forming walls 40 are arranged, to the outer peripheral wall 60.

The second partition wall 82 partitions the exhaust-side space, which is positioned closer to the exhaust-side space than the valve hole-forming walls 40 and the first partition wall 81 in the X-axis direction, into a lower space that includes portions below the exhaust port-forming portions 52 in the Z-axis direction and an upper space that includes portions above the exhaust port-forming portions 52.

The head-side flow space 30 is partitioned into a first cooling water space 31 including the intake-side space and an upper exhaust-side space and a second cooling water space 32 formed of a lower exhaust-side space by the first partition wall 81 and the second partition wall 82.

<Rocker Housing>

As shown in FIGS. 1 and 2, a rocker housing 6 is formed integrally with the cylinder head body 3A of the present embodiment. The rocker housing 6 includes a rocker-side wall 6A. The rocker-side wall 6A is formed at the peripheral edge of the upper surface 22*a* of the upper deck 22 (cylinder head body 3A) so as to extend toward the upper side of the cylinder head body 3A (the positive side in the Z-axis direction), and surrounds the rocker arms 47 and the like provided on the upper surface 22*a* of the upper deck 22. Further, an intake manifold 3C is formed integrally with the cylinder head body 3A of the present embodiment. The intake manifold 3C is connected to the intake-side side wall 61 of the cylinder head body 3A. The intake manifold 3C extends in the first orthogonal direction so that the interior space of the intake manifold 3C communicates with each of the plurality of intake ports 53 arranged in the Y-axis direction.

<Expansion Portion>

Figure 4:
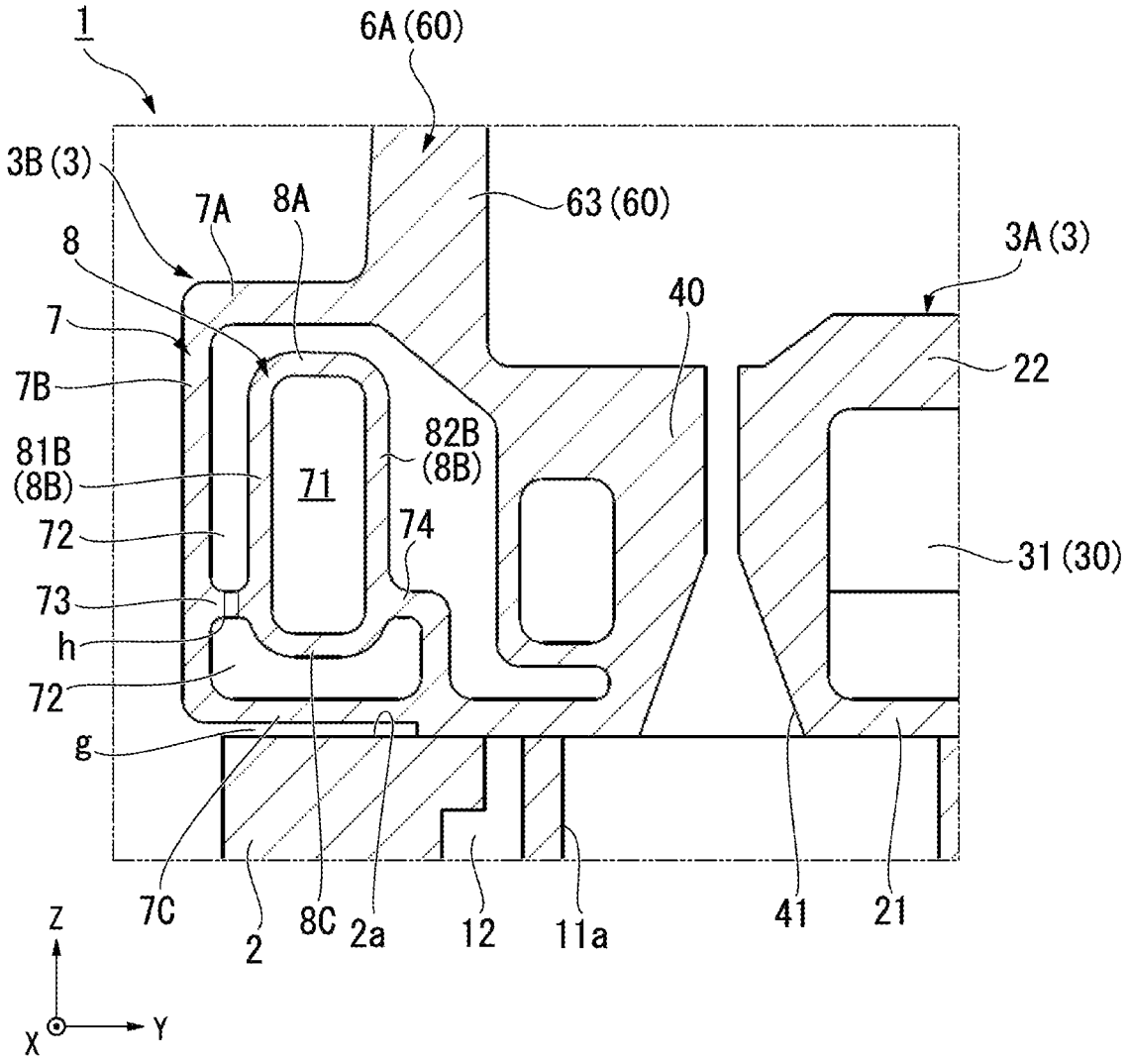
FIG. 4 is an enlarged view of a main portion of FIG. 3.

As shown in FIGS. 1 to 4, the expansion portion 3B is integrally provided on one side of the cylinder head body 3A in the Y-axis direction. That is, the expansion portion 3B expands from the cylinder head body 3A to one side in the cylinder-row direction. As shown in FIGS. 3 and 4, the expansion portion 3B extends over the lower deck 21 and the rocker-side wall 6A in the vertical direction.

As shown in FIG. 4, the expansion portion 3B includes an expansion wall portion 7. The expansion wall portion 7 includes an upper wall 7A, a side wall 7B, and a lower wall 7C. The upper wall 7A protrudes from the rocker-side wall 6A to one side of the cylinder-row direction. The upper wall 7A is positioned above the above-mentioned upper deck 22 in the vertical direction. That is, in the present embodiment, the upper surface of the upper wall 7A is positioned above the upper surface of the upper deck 22 and the lower surface of the upper wall 7A is positioned above the lower surface of the upper deck 22. The side wall 7B extends downward from an end edge of the upper wall 7A that is provided on one side in the cylinder-row direction. The lower wall 7C connects the lower end edge of the side wall 7B to the lower deck 21. A gap g is formed between the lower surface of the lower wall 7C and the upper surface 2*a* of the cylinder block 2. Since this gap g is formed, the transfer of heat to the expansion wall portion 7 from the cylinder block 2 is suppressed.

Figure 5:
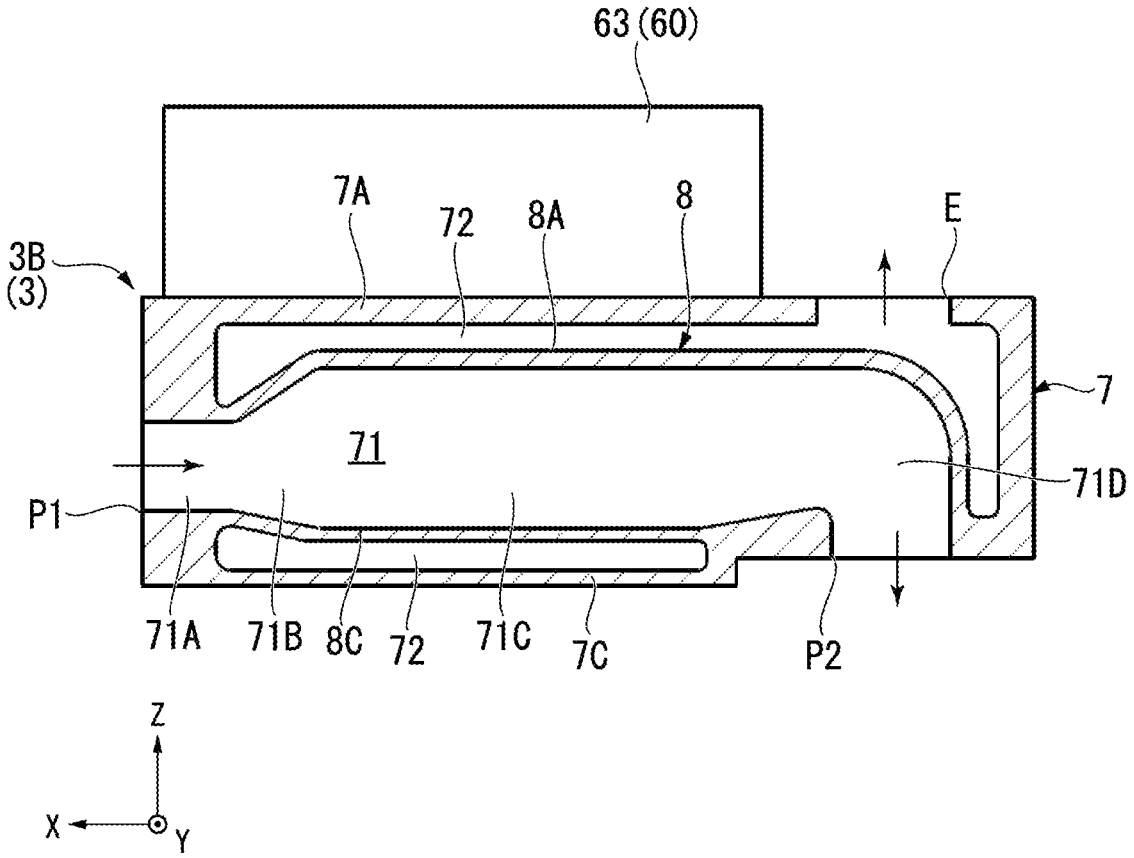
FIG. 5 is a cross-sectional view taken along line V-V of FIG. 2.

A second cooling water space 72 in which cooling water flows is formed in the expansion wall portion 7. This second cooling water space 72 communicates with one side of the above-mentioned first cooling water space 31 in the cylinder-row direction. That is, a part of cooling water supplied through the first cooling water space 31 flows in the second cooling water space 72. Since the upper wall 7A of the expansion wall portion 7 is positioned above the upper deck 22 as described above, the second cooling water space 72 extends up to a position over the upper deck 22. As shown in FIG. 5, cooling water having flowed through the second cooling water space 72 is discharged through a discharge portion E that is formed at the upper portion of the expansion wall portion 7.

<EGR Passage-Forming Portion>

As shown in FIGS. 3 and 4, an EGR passage-forming portion 8 is provided in the second cooling water space 72. The EGR passage-forming portion 8 is formed in the second cooling water space 72 and has the shape of a tube extending in the X-axis direction. As shown in FIG. 4, the EGR passage-forming portion 8 includes an upper wall 8A, a pair of side walls 8B and 8B, and a lower wall 8C. The upper wall 8A and the lower wall 8C face each other in the Z-axis direction. The pair of side walls 8B and 8B connects the upper wall 8A to the lower wall 8C in the Z-axis direction. The upper wall 8A is positioned above the above-mentioned upper deck 22.

The periphery of the EGR passage-forming portion 8 is filled with cooling water. More specifically, all of the upper wall 8A, the pair of side walls 8B and 8B, and the lower wall 8C are exposed to the cooling water. An EGR passage 71 in which EGR gas flows is formed in the EGR passage-forming portion 8. One end of the EGR passage 71 communicates with an exhaust manifold (not shown) mounted on the cylinder head body 3A. The other end of the EGR passage 71 communicates with the above-mentioned intake manifold 3C. Part of exhaust gas guided from the exhaust manifold is sent to the intake manifold after flowing through the EGR passage 71.

As shown in FIG. 5, the EGR passage 71 includes an introduction portion 71A, an enlarged portion 71B, a body portion 71C, and a bent portion 71D that are connected in this order from one end (introduction port P1) toward the other end (discharge port P2). One end of the introduction portion 71A is formed of an introduction port P1. The introduction port P1 is connected to the exhaust manifold. In the enlarged portion 71B, the cross-sectional area of a flow passage is gradually increased from the introduction portion 71A toward the body portion 71C. Specifically, in the enlarged portion 71B, the dimensions of the flow passage in the vertical direction are gradually increased toward the body portion 71C. In the body portion 71C, the cross-sectional area of a flow passage is constant over the entire extension length thereof. The bent portion 71D is gradually bent downward from the downstream end portion of the body portion 71C toward the discharge port P2. That is, the discharge port P2 is open downward.

<First Connection Portion, Second Connection Portion>

Figure 6:
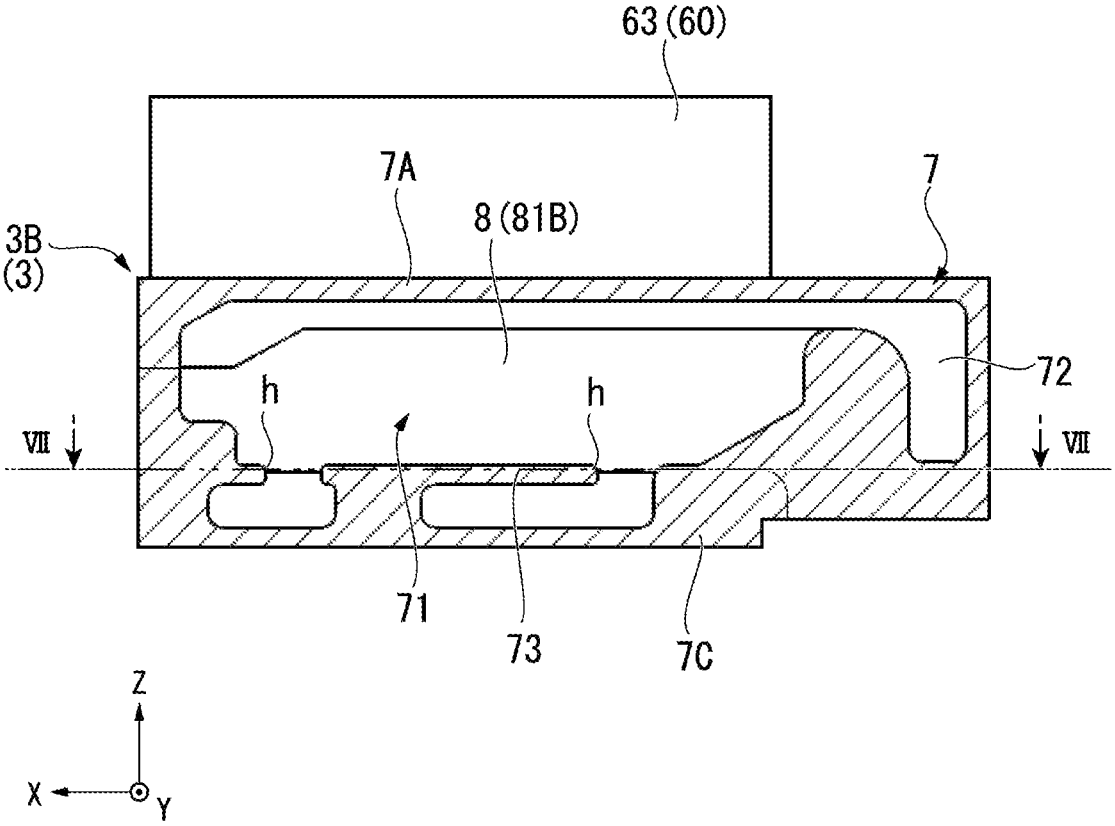
FIG. 6 is a cross-sectional view taken along line VT-VT of FIG. 2.
Figure 7:
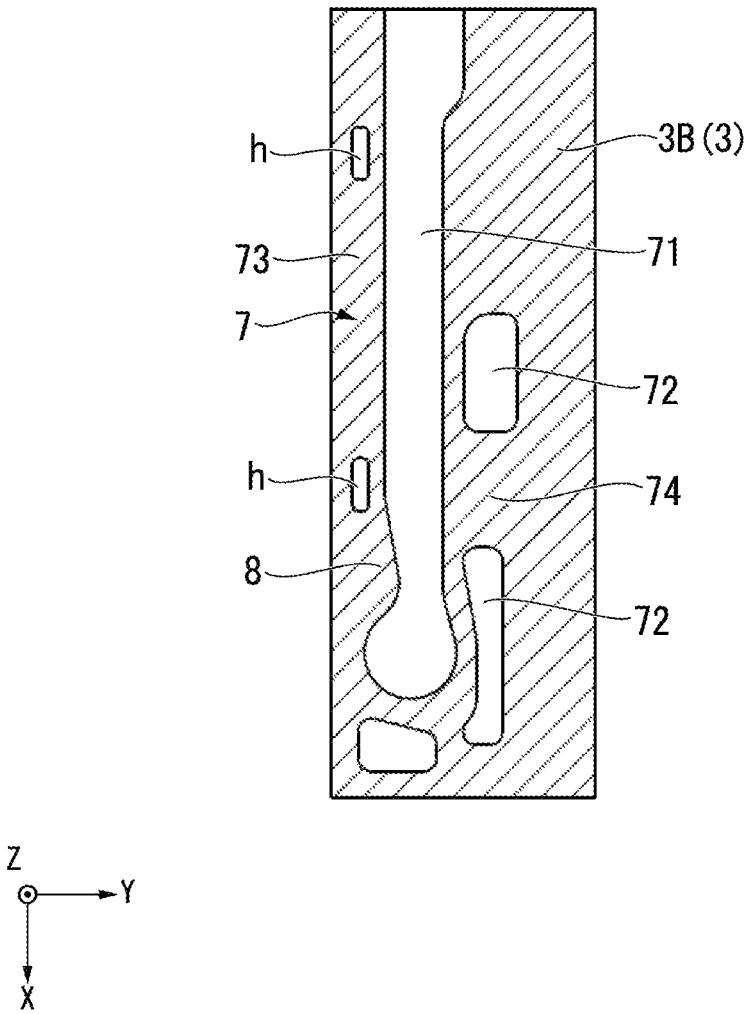
FIG. 7 is a cross-sectional view taken along line VII-VII of FIG. 6.

As shown in FIGS. 4 and 6, one side wall 8B (a first side wall 81B provided on one side in the cylinder-row direction) of the pair of side walls 8B and 8B of the EGR passage-forming portion 8 is connected to the side wall 7B of the expansion wall portion 7 in the cylinder-row direction by a first connection portion 73. The first connection portion 73 has the shape of a plate that extends in the cylinder-row direction and the front-rear direction. As shown in FIGS. 4, 6, and 7, a plurality of (two in the example shown in the drawing) communicating holes h penetrating the first connection portion 73 in the vertical direction are formed in the first connection portion 73. As shown in FIG. 7, each communicating hole h is an elongated hole (slit) of which the longitudinal direction corresponds to the front-rear direction. An upper space and a lower space communicate with each other through these communicating holes h with the first connection portion 73 interposed therebetween.

In addition, as shown in FIG. 4, the other side wall 8B (a first side wall 82B corresponding to the other side in the Y-axis direction) of the pair of side walls 8B and 8B of the EGR passage-forming portion 8 is connected to the cylinder head body 3A in the cylinder-row direction by a second connection portion 74. The second connection portion 74 has the shape of a plate that extends in the cylinder-row direction and the front-rear direction.

<Effects>

In the cylinder head 3 according to the present embodiment, part of exhaust gas sent to the exhaust manifold is guided to the intake manifold 3C through the EGR passage 71 and flows to return to the cylinder head 3. Since the periphery of the EGR passage 71 is covered with the second cooling water space 72 (cooling water), exhaust gas flowing through the EGR passage 71 is gradually cooled in the middle of flowing and is sent to the intake manifold 3C in a state where the temperature of the exhaust gas is a relatively low temperature.

Here, in the present embodiment, the expansion portion 3B is formed so as to expand over the lower deck 21 and the rocker-side wall 6A. Accordingly, the second cooling water space 72 extends up to a position over the upper deck 22. That is, a large second cooling water space 72 can be ensured particularly in the vertical direction. Further, since the EGR passage 71 (EGR passage-forming portion 8) is disposed in the second cooling water space 72 having this large volume, the cooling efficiency of exhaust gas flowing through the EGR passage 71 can be further improved.

Furthermore, since the rocker-side wall 6A and the upper deck 22 are formed integrally with each other, bolt holes used to mount the rocker-side wall 6A on the upper deck 22 do not need to be formed unlike in the related art. In a case where the bolt holes are formed, the volume of the second cooling water space 72 is restricted by an area occupied by the bolt holes. However, in the present embodiment, it is possible to avoid such a restriction and to ensure the large volume of the second cooling water space 72.

Moreover, in the cylinder head 3 according to the present embodiment, an upper end (upper wall 8A), which extends in the front-rear direction, of the EGR passage-forming portion 8 is positioned above the upper deck 22. Accordingly, since the large surface area of the EGR passage-forming portion 8 (that is, the large contact area between the EGR passage-forming portion 8 and the second cooling water space 72) can be ensured, the cooling efficiency of EGR gas can be further improved.

Further, the cylinder head 3 according to the present embodiment is provided with the first connection portion 73 that is provided on one side of the EGR passage-forming portion 8 in the cylinder-row direction and connects the EGR passage-forming portion 8 to the expansion portion 3B, and the second connection portion 74 that is provided on the other side thereof in the cylinder-row direction and connects the EGR passage-forming portion 8 to the cylinder head body 3A. Here, in the cylinder head 3, a force is applied to the cylinder head body 3A upward by combustion gas generated in the cylinder bores 11*a*. Since the EGR passage-forming portion 8 is connected to the cylinder head body 3A and the expansion portion 3B by the first connection portion 73 and the second connection portion 74, the force is also applied to the EGR passage-forming portion 8. In other words, the EGR passage-forming portion 8 itself can be used as part of a strength member and can bear strength. Accordingly, the durability of the cylinder head 3 can be further improved.

In addition, the communicating holes h penetrating the first connection portion 73 in the vertical direction are formed in the first connection portion 73. Since cooling water passes through the communicating holes h, it is possible to reduce the possibility that the stagnation or stay of cooling water may occur in the second cooling water space 72. As a result, the entire EGR passage-forming portion 8 can be efficiently cooled from the periphery thereof.

<Other Embodiments>

The embodiments of the present invention have been described above, but the present invention is not limited thereto and can be appropriately modified without departing from the scope of the present invention.

The number of cylinders of the engine according to the embodiment of the present invention may be, for example, one. That is, the number of the valve hole-forming walls of the cylinder head of the present invention may be, for example, one.

The engine according to the present invention may be applied to any work vehicle, such as a dump truck, a hydraulic shovel, a wheel loader, a bulldozer, or an engine type forklift.

INDUSTRIAL APPLICABILITY

According to the cylinder head and the engine, EGR gas can be more efficiently cooled.

REFERENCE SIGNS LIST

1 Engine
2 Cylinder block
3 Cylinder head
3A Cylinder head body
3B Expansion portion
6 Rocker housing
6A Rocker-side wall
7 Expansion wall portion
8 EGR passage-forming portion
11 Cylinder
11*a* Cylinder bore
12 Block-side flow space
21 Lower deck
21*a* Upper surface
21*b* Lower surface
22 Upper deck
30 Head-side flow space
31 First cooling water space
32 Second cooling water space
40 Valve hole-forming wall
41 Intake valve hole
42 Exhaust valve hole
44 Fuel injector
51 Intake port-forming wall
52 Exhaust port-forming portion
53 Intake port
54 Exhaust port
60 Outer peripheral wall
61, 62 Side wall
71 EGR passage
72 Second cooling water space
81 First partition wall
82 Second partition wall

The invention claimed is:

1. A cylinder head comprising:

a cylinder head body that includes a lower deck, an upper deck provided above the lower deck so as to face the lower deck and defining a first cooling water space together with the lower deck, and a plurality of valve hole-forming walls extending over the lower deck and the upper deck and formed in a cylinder-row direction;

a rocker housing including a rocker-side wall that is formed integrally with the cylinder head body so as to stand up from an end portion of the upper deck provided on one side in the cylinder-row direction;

an expansion wall portion that is provided overlapping the lower deck from a vertical direction and at least partially overlapping the rocker-side wall in a direction parallel to the engine's longitudinal axis so as to expand from the cylinder head body to one side in the cylinder-row direction and defines a second cooling water space communicating with one side of the first cooling water space in the cylinder-row direction and extending up to a position over the upper deck; and an EGR passage-forming portion that is provided in the second cooling water space and extends in a front-rear direction crossing the cylinder-row direction, configured to form a flow passage for exhaust gas having a cross-sectional area that gradually increases from an introduction portion toward an enlarged body portion where temperature of the exhaust gas is gradually cooled.

2. The cylinder head according to claim 1, wherein an upper end, which extends in the front-rear direction, of the EGR passage-forming portion is positioned above the upper deck.

3. The cylinder head according to claim 2, further comprising:

a first connection portion that is provided on one side of the EGR passage-forming portion in the cylinder-row direction and connects the EGR passage-forming portion to the expansion wall portion; and a second connection portion that is provided on the other side of the EGR passage-forming portion in the cylinder-row direction and connects the EGR passage-forming portion to the cylinder head body.

4. The cylinder head according to claim 3, wherein the first connection portion extends in the front-rear direction and includes a communicating hole that penetrates the first connection portion in a vertical direction.

5. An engine comprising:

the cylinder head according to any one of claim 4; and a cylinder block that includes a cylinder bore forming a cylinder and is covered with the cylinder head from above.

6. An engine comprising:

the cylinder head according to any one of claim 3; and a cylinder block that includes a cylinder bore forming a cylinder and is covered with the cylinder head from above.

7. An engine comprising:

the cylinder head according to any one of claim 2; and a cylinder block that includes a cylinder bore forming a cylinder and is covered with the cylinder head from above.

8. The cylinder head according to claim 1, further comprising:

a first connection portion that is provided on one side of the EGR passage-forming portion in the cylinder-row direction and connects the EGR passage-forming portion to the expansion wall portion; and a second connection portion that is provided on the other side of the EGR passage-forming portion in the cylinder-row direction and connects the EGR passage-forming portion to the cylinder head body.

9. The cylinder head according to claim 8, wherein the first connection portion extends in the front-rear direction and includes a communicating hole that penetrates the first connection portion in a vertical direction.

10. An engine comprising:

the cylinder head according to any one of claim 9; and a cylinder block that includes a cylinder bore forming a cylinder and is covered with the cylinder head from above.

11. An engine comprising:

the cylinder head according to any one of claim 8; and a cylinder block that includes a cylinder bore forming a cylinder and is covered with the cylinder head from above.

12. An engine comprising:

the cylinder head according to any one of claim 1; and a cylinder block that includes a cylinder bore forming a cylinder and is covered with the cylinder head from above.

13. The cylinder head according to claim 1, wherein a periphery of the an EGR passage-forming portion is covered with that is provided in the second cooling water space, inside of the EGR passage-forming portion, an EGR passage through which EGR gas flows is formed, and the EGR passage-forming portion extends in a front-rear direction crossing the cylinder-row direction.

14. The cylinder head according to claim 1, wherein the EGR passage-forming portion is formed in the second cooling water space and has the shape of a tube extending in the front-rear direction, and the periphery of the EGR passage-forming portion includes an upper wall, a pair of side walls, and a lower wall.

* * * * *